US011459839B2

(12) United States Patent
Greenlee

(10) Patent No.: US 11,459,839 B2
(45) Date of Patent: Oct. 4, 2022

(54) SLEEVE FOR DOWNHOLE TOOLS

(71) Applicant: Nine Downhole Technologies, LLC, Houston, TX (US)

(72) Inventor: Donald Roy Greenlee, Murchison, TX (US)

(73) Assignee: Nine Downhole Technologies, LLC, Houston, TX (US)

( * ) Notice: Subject to any disclaimer, the term of this patent is extended or adjusted under 35 U.S.C. 154(b) by 0 days.

(21) Appl. No.: 16/838,809

(22) Filed: Apr. 2, 2020

(65) Prior Publication Data

US 2021/0310322 A1 Oct. 7, 2021

(51) Int. Cl.
*E21B 23/00* (2006.01)
*E21B 33/12* (2006.01)
*E21B 34/14* (2006.01)

(52) U.S. Cl.
CPC ..... *E21B 23/00* (2013.01); *E21B 33/12* (2013.01); *E21B 34/14* (2013.01)

(58) Field of Classification Search
CPC ..... E21B 23/00; E21B 34/14; E21B 33/12
See application file for complete search history.

(56) References Cited

U.S. PATENT DOCUMENTS 2,881,840 A * 4/1959 Wright ..... E21B 37/02 166/173
3,074,483 A * 1/1963 Solum ..... E21B 37/02 166/172
3,213,943 A * 10/1965 Solum ..... E21B 37/02 166/173
3,758,145 A * 9/1973 Kinley ..... E21B 31/12 294/86.23
3,885,627 A * 5/1975 Berry ..... E21B 34/08 137/68.17
4,004,835 A * 1/1977 Taylor ..... E21B 31/18 294/86.29
4,082,144 A * 4/1978 Marquis ..... E21B 23/08 166/242.6
4,520,886 A * 6/1985 Marais ..... E21B 4/14 91/50
4,595,058 A * 6/1986 Nations ..... E21B 17/22 166/380
4,767,145 A * 8/1988 Bullard ..... E21B 23/02 294/86.18

(Continued)

*Primary Examiner* — Steven A MacDonald
(74) *Attorney, Agent, or Firm* — Vinson & Elkins L.L.P.

(57) ABSTRACT

Aspects of the present disclosure relate to a downhole tool having a plurality of turbulence-generating channels. Other aspects of the disclosure relate to downhole tools having one or more ports. Embodiments further include methods for connecting the downhole tool to a wireline system and performing a pump-down operation where the plurality of turbulence-generating channels of the downhole tool create turbulence in fluid being pumped around the downhole tool, creating a force on the downhole tool in a downhole direction. Embodiments further include methods where a component moving in the cavity of the downhole tool unseals the opening at the downhole end of the substantially cylindrical body; and pulling the downhole tool in an uphole direction in the wellbore, wherein fluid in the wellbore passes through the port, into the cavity, and out of the opening on the downhole end of the downhole tool.

16 Claims, 5 Drawing Sheets

(56) References Cited

U.S. PATENT DOCUMENTS 5,507,346 A * 4/1996 Gano ..... E21B 23/00 166/242.1
5,984,009 A * 11/1999 DiFoggio ..... E21B 47/09 73/152.56
6,227,297 B1 * 5/2001 Milam ..... B08B 9/023 166/173
6,935,427 B1 * 8/2005 Billingsley ..... E21B 31/18 166/99
7,314,080 B2 * 1/2008 Giacomino ..... E21B 34/14 417/56
7,513,167 B1 * 4/2009 Serata ..... E21B 49/006 73/820
7,793,728 B2 * 9/2010 Bender ..... E21B 37/045 166/372
9,976,548 B2 * 5/2018 Zimmerman, Jr. ..... F04B 47/12
10,006,274 B2 * 6/2018 Cedillo ..... E21B 43/123
10,047,585 B2 * 8/2018 Pickle ..... E21B 33/04
10,927,627 B2 * 2/2021 Eitschberger ..... E21B 23/0412
2003/0111224 A1 * 6/2003 Hailey, Jr. ..... E21B 34/06 166/278
2009/0260834 A1 * 10/2009 Henson ..... G02B 6/4464 385/13
2009/0308656 A1 * 12/2009 Chitwood ..... E21B 4/04 175/40
2015/0247372 A1 * 9/2015 Angeles Boza ..... E21B 33/12 166/50
2015/0354350 A1 * 12/2015 Joseph ..... E21B 23/02 166/177.6
2016/0108710 A1 * 4/2016 Hightower ..... E21B 43/121 166/372
2017/0356276 A1 * 12/2017 Nelson ..... F04B 39/0005
2020/0131880 A1 * 4/2020 Macrae ..... E21B 34/10
2021/0025267 A1 * 1/2021 Christie ..... E21B 43/26
2021/0215039 A1 * 7/2021 Scharf ..... E21B 23/14

* cited by examiner

SLEEVE FOR DOWNHOLE TOOLS

TECHNICAL FIELD

Aspects of the disclosed technology include downhole tools with drag- and turbulence-generating channels, and can further include downhole tools with bypass ports.

BACKGROUND

In many circumstances, it may be desirable to perform a pump-down operation to convey a downhole tool in a wellbore by pumping fluid into the wellbore above a downhole tool on a wireline. In this way, there is no need to assemble a drillstring to convey the downhole tool to a desired depth in the wellbore. These pump-down operations are often performed as part of plug-and-perf operations supporting hydraulic fracturing, although the disclosed technology as described herein can be used on any tool intended to be conveyed via a pump-down operation.

To prevent damage to the tool and wellbore, tools used in pump-down operations frequently are under-sized for the wellbore, and do not snugly fit into the wellbore. Instead, a gap is present between the downhole tool and the wellbore. This under-sizing is done for a variety of reasons, including to reduce friction between the wellbore and the downhole tool, and to allow the downhole tool to pass through curved wellbores, such as deviated or horizontal wells. This under-sizing creates a gap between the outer diameter of the downhole tool and the inner diameter of the wellbore. As a result, during pump-down operations, a portion of the fluid pumped into the wellbore can travel around the downhole tool and into the wellbore below the tool.

This fluid bypassing the tool is a loss mechanism that can slow down a tool as it is pumped down the wellbore. In order for the pump-down operation to move the downhole tool, it must create a difference in pressure between the fluid above the downhole tool and below the tool by pumping fluid into the wellbore above the tool. This difference in pressure causes a net force on the downhole tool which causes the downhole tool to move. However, fluid passing between the downhole tool and the wellbore can reduce the difference in pressure between the uphole and downhole ends of the downhole tool, resulting in either slower movement or an increased pumping rate to maintain a given speed.

One solution to minimize the bypass gap would be to increase the diameter of the downhole tool to minimize the size of the gap, or to provide a gasket seal to seal off the gap. However, shrinking the size of gap can cause the tool to bind in curved segments of a wellbore, increasing the chances that the tool will break or stick, leading to costly downtime. Further, gasket seals create substantial friction force between downhole tool and wellbore, slowing the speed of downhole tool, and creating a risk that the gaskets will wear away and fail.

The present disclosed technology describes an innovative mechanism for increasing the pressure differential between the fluid in an uphole direction from the downhole tool, and the pressure in a downhole direction from the downhole tool. By placing structures on the outer surface of the downhole tool that create drag or turbulence, hydrodynamic forces can be used to minimize the amount of fluid that travels through the gap, and thus a higher pressure can be maintained across the tool. This, and many other advantages are provided by the disclosed technology, among other advantages.

SUMMARY

Aspects of the present disclosed technology relate to a downhole tool, comprising: a substantially cylindrical body, having an uphole end and a downhole end, and an exterior surface; a plurality of turbulence-generating channels formed in the substantially cylindrical body, each channel running along a circumference of the body substantially perpendicular to a central axis of the body; and wherein the body has a substantially cylindrical cavity therein, and wherein the body has an opening proximate to the downhole end in fluid communication with the cavity, wherein the body has a port between the exterior surface and cavity of the body.

In some embodiments, the port is located in an uphole direction from a substantial portion of the plurality of turbulence-generating channels. In some embodiments, the downhole tool further comprises a component disposed within the cavity that seals the opening. In some embodiments, the component has a passageway having a first opening and a second opening, the first opening having substantially the same size and shape as the port, and wherein the first opening is offset from the port, and the second opening is in a downhole direction from the first opening. In some embodiments, the substantially cylindrical body has an exterior surface adjacent to the plurality of turbulence-generating channels, wherein a radius from the axis of the substantially cylindrical body to the bottom surface of the plurality of turbulence-generating channels is smaller than a radius from the axis of the substantially cylindrical body to the exterior surface.

In some embodiments, a radius from the axis of the substantially cylindrical body to the maximum radius of any element of the channels is larger than the radius from the axis of the substantially cylindrical body to the exterior surface. In some embodiments, the downhole tool comprises a setting device for wellbore plugs, and wherein the component is a mandrel of the setting device. In some embodiments, a height of the uphole surface is substantially greater than the height of the downhole surface. In some embodiments, the bottom surface is semi-circular. In some embodiments, the plurality of turbulence-generating channels cover a majority of the exterior surface of the downhole tool. In some embodiments, the plurality of turbulence-generating channels are located proximate to the downhole end of the downhole tool.

In some embodiments, the first turbulence-generating channel is adjacent to the second turbulence-generating channel, wherein the second turbulence-generating channel is adjacent to the third turbulence-generating channel, and wherein the spacing between the first turbulence-generating channel and the second turbulence-generating channel is greater than the spacing between the second turbulence-generating channel and the third turbulence-generating channel.

Aspects of the present disclosed technology include methods that comprise connecting the downhole tool to a wireline system, wherein the downhole tool comprises: a substantially cylindrical body, having an uphole end and a downhole end; a plurality of turbulence-generating channels formed in the substantially cylindrical body, each channel running along a circumference of the body substantially perpendicular to a central axis of the body; and wherein the body has a substantially cylindrical cavity therein, and wherein the body has an opening proximate to the downhole end in fluid communication with the cavity, wherein the body has a port between the exterior surface and cavity of the body, and performing a pump-down operation with the downhole tool in a wellbore, wherein the plurality of turbulence-generating channels of the downhole tool create turbulence in fluid being pumped around the downhole tool, creating a force on the downhole tool in a downhole direction.

In some embodiments, the downhole tool further comprises a component disposed within the cavity that seals the opening, and wherein the method further comprises: performing an operation with the downhole tool that results in the component moving in the cavity of the downhole tool and un-sealing the opening at the downhole end of the substantially cylindrical body; and pulling the downhole tool in an uphole direction in the wellbore, wherein fluid in the wellbore passes through the port, into the cavity, and out of the opening on the downhole end of the downhole tool.

In some embodiments, the downhole tool further comprises a setting tool and a plug in an un-set position on the downhole end of the downhole tool, and wherein the operation comprises setting the plug into a set position. In some embodiments, the component of the downhole assembly has a passageway having a first opening and a second opening, the first opening having substantially the same size and shape as the port, and wherein the first opening is offset from the port, and the second opening in a downhole direction from the first opening, and wherein the step of performing an operation further comprises moving the component into a position where the first opening is in fluid communication with the port and the second opening is in communication with the downhole end of the downhole tool. In some embodiments, the pump down operation causes the downhole tool to move in a downhole direction in the wellbore at a speed of approximately 400 to 600 feet per minute. In some embodiments, the step of pulling the downhole tool in an uphole direction causes the downhole tool to move in an uphole direction at a speed of greater than 800 feet per minute.

BRIEF DESCRIPTION OF THE FIGURES

Included in the present specification are figures which illustrate various embodiments of the present disclosed technology. As will be recognized by a person of ordinary skill in the art, actual embodiments of the disclosed technology need not incorporate each and every component illustrated, but may omit components, add additional components, or change the general order and placement of components. Reference will now be made to the accompanying figures and flow diagrams, which are not necessarily drawn to scale, where like numerals denote common features between the drawings, and wherein.

DETAILED DESCRIPTION

Figure 1:
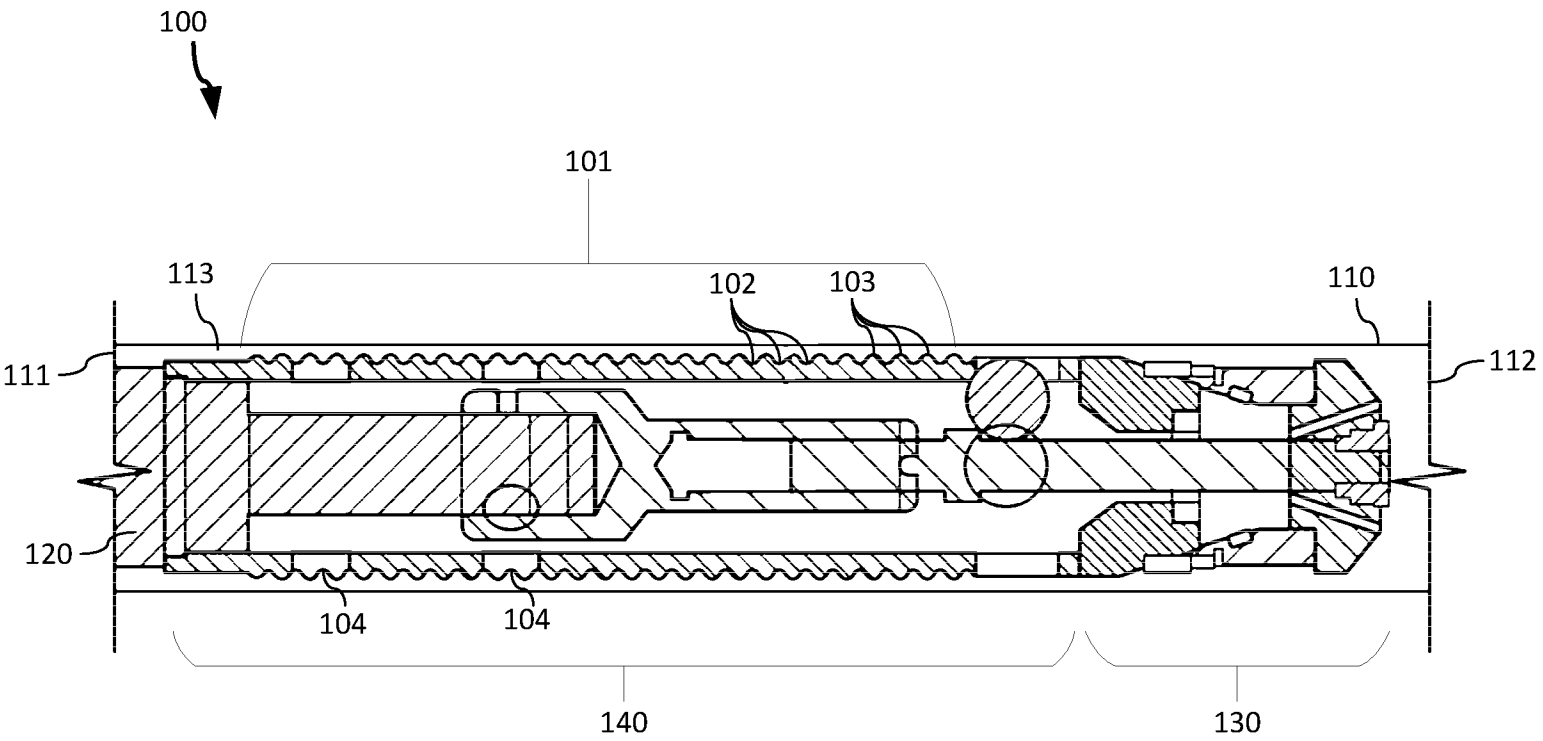
FIG. 1 depicts a downhole tool in a run-in configuration in accordance with an embodiment having a textured sleeve with channels and ridges, as well as bypass ports incorporated into the outer surface of the tool.

The present invention will now be described with reference to the accompanying drawings, in which preferred example embodiments of the invention are shown. The invention may, however, be embodied in other forms and should not be construed as limited to the herein disclosed embodiments. The disclosed embodiments are provided to fully convey the scope of the invention to the skilled person. Although example embodiments of the present disclosure are explained in detail, it is to be understood that other embodiments are contemplated. Accordingly, it is not intended that the present disclosure be limited in its scope to the details of construction and arrangement of components set forth in the following description or illustrated in the drawings. The present disclosure is capable of other embodiments and of being practiced or carried out in various ways.

It must also be noted that, as used in the specification and the appended claims, the singular forms "a," "an" and "the" include plural referents unless the context clearly dictates otherwise. Moreover, titles or subtitles may be used in this specification for the convenience of a reader, which have no influence on the scope of the present disclosure.

By "comprising" or "containing" or "including" is meant that at least the named compound, element, particle, or method step is present in the composition or article or method, but does not exclude the presence of other compounds, materials, particles, method steps, even if the other such compounds, material, particles, method steps have the same function as what is named.

In describing example embodiments, terminology will be resorted to for the sake of clarity. It is intended that each term contemplates its broadest meaning as understood by those skilled in the art and includes all technical equivalents that operate in a similar manner to accomplish a similar purpose.

In the following detailed description, references are made to the accompanying drawings that form a part hereof and that show, by way of illustration, specific embodiments or examples. In referring to the drawings, like numerals represent like elements throughout the several figures.

While the preferred embodiment to the invention has been described, it will be understood that those skilled in the art, both now and in the future, may make various improvements and enhancements which fall within the scope of the claims which follow. These claims should be construed to maintain the proper protection for the invention first described.

FIG. 1 depicts a downhole tool 100 located in a wellbore 110 in a run-in configuration in accordance with an embodiment. The wellbore 110 has an uphole direction 111 which leads to the surface, and a downhole direction 112 which leads to the point in the wellbore furthest from the surface. Downhole tool 100 is attached to a wireline assembly 120 and can comprise, for example, a plug 130 and a setting tool 140.

The downhole tool 100 has a textured sleeve 101 with a plurality of drag-producing channels 102 and ridges 103. The textured sleeve 101 is used to improve the ability of the downhole tool 100 to be pumped down a wellbore. In a pump-down operation, the downhole tool 100 is connected to a wireline assembly and placed into wellbore 110. Pressurized fluid is then pumped from the surface to convey the downhole tool from the surface to a targeted location in the wellbore. This pressurized fluid can be used to increase the speed of the downhole tool over the speed possible using gravity alone, and also to allow the downhole tool to travel through highly-deviated and/or horizontal wellbores where gravity is insufficient to move the tool. This operation requires that the a pressure differential be maintained above and below the tool, such that higher pressure above the tool than below the tool creates a net force in a downhole direction 112 to move the tool. However, downhole tool 100 has an outer diameter that is smaller than the inner diameter of wellbore 110, creating a gap 113 between the downhole tool 110 and the wellbore 110. During a pump-down operation, pressurized fluid is able to travel through gap 113 from the high-pressure side to the low-pressure side in a downhole direction from the tool 112. This fluid passing through gap 113 is a loss mechanism that leads to inefficiency. For example, fluid passing through the gap 113 can cause the downhole tool 100 to travel more slowly through the wellbore, or require a higher pressure and higher volume of fluid to be pumped from the surface to maintain a targeted speed of the downhole tool 100.

The textured sleeve 101 has a plurality of drag and/or turbulence generating structures on the surface, such as a plurality of channels 102 and ridges 103 that create a drag force on the fluid passing through gap 113. The downhole tool 100 in FIG. 1 depicts a textured sleeve with a cross-section that comprises hemispherical channels 102 and ridges 103. However, such ridges can comprise a variety of shapes. For example This drag force impedes the flow of fluid from an uphole side of the downhole tool 100 from passing to the downhole side through the gap 113. Because fluid cannot pass through gap 113, a greater pressure differential can be maintained across the tool 113.

The downhole tool 100 can comprise one or more tools for use in a wellbore. For example, FIG. 1 depicts a downhole tool 100 comprising a wellbore plug 130 and a setting tool 140 for the wellbore plug. However, the present disclosed technology is not so limited—any other downhole tool intended for use in a pump-down operation can be fitted with textured sleeve 101, either as a sleeve attached to the outside of the tool, or formed into the outer surface of the tool.

In some embodiments, the downhole tool 100 can further comprise one or more ports 104 in the outer surface of the downhole tool. The downhole tool 100 can be connected to a wireline assembly via a wireline adapter assembly 120. Ports 104 can be formed in the outer surface of the downhole tool 104 as fluid bypass routes around the textured sleeve 101. As depicted in FIG. 1 in a run-in configuration, fluid cannot pass from the fluid ports 104 to the downhole end of the downhole tool 100 because the plug 130 substantially blocks the fluid's path. As a result, in a run-in configuration, the ports do not allow fluid to flow through the ports and out the downhole end of the tool.

Figure 2:
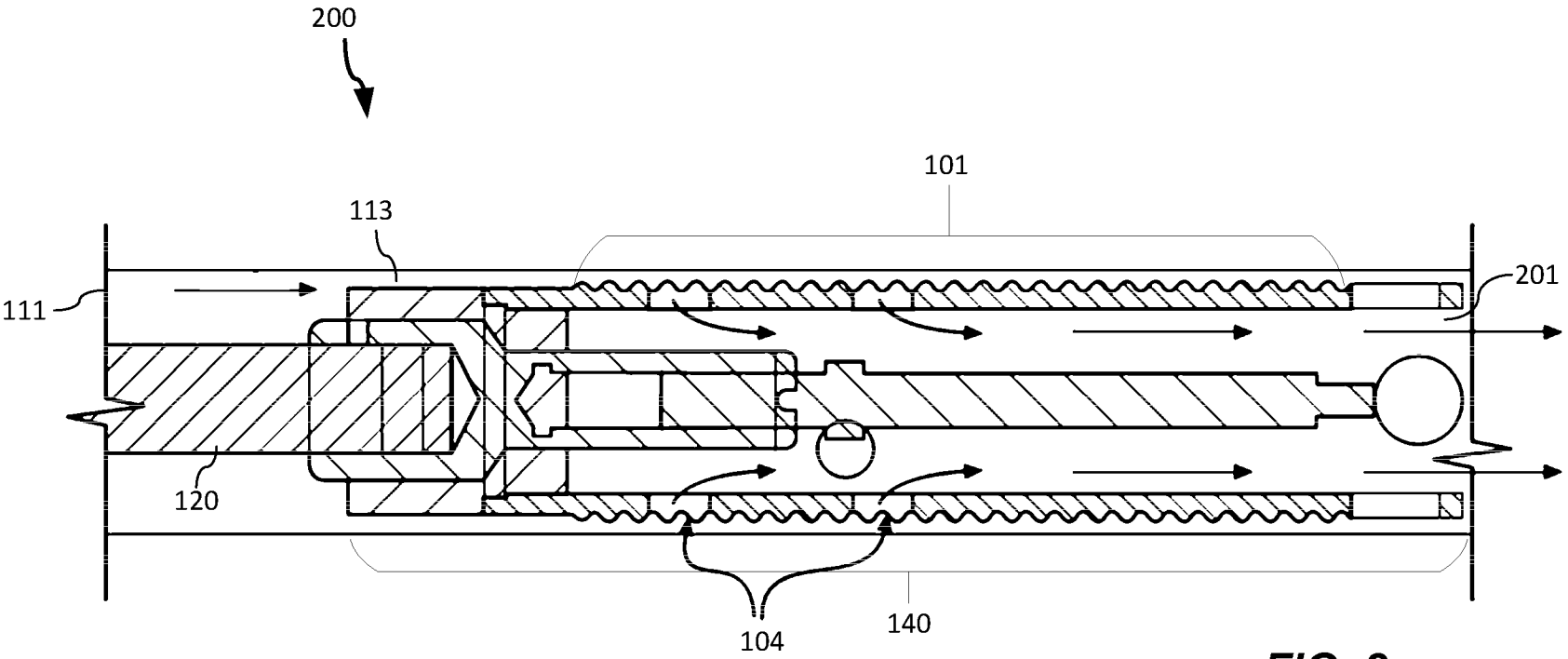
FIG. 2 depicts the downhole tool in a run-out configuration in accordance with an embodiment.

FIG. 2 depicts the downhole tool 100 of FIG. 1 in a run-out configuration. While the configuration of downhole tool shown in FIG. 1 enhances the pressure difference of fluid above and below the tool, such a pressure difference can be disadvantageous when the downhole tool 100 is pulled up the well. That is, during a pump-down operation with a wireline, the tool is pulled uphole on a wire attached to wireline assembly 120. When the tool is pulled, the movement of the tool can create a higher pressure above the tool than below the tool, creating a net drag force in a downhole direction 112, opposite the direction of intended movement.

To solve this problem, one or more ports 104 can be used to create a bypass path for fluid In this configuration, plug 130 has been set in the wellbore, and detached from downhole tool 110, leaving the setting tool to be retrieved via the wireline assembly 120. In the absence of plug 130, a fluid path is present between the one or more ports 104 and the open end 201 of the downhole tool 100. Thus, as shown by the flow arrows, fluid is able to travel through the one or more ports 104 and out the open end 201, bypassing at least a portion of the textured sleeve 101.

In the embodiment depicted in FIGS. 1 and 2, the ports are sealed by the presence of plug 130 which is then detached prior to running the tool out of the hole. However, the invention includes other methods of selectively allowing or restricting the flow of fluid through ports 104 in run in and run-out configurations. For example, an inner sleeve can be provided inside the downhole tool 100 that, when in a run-in configuration, obstructs fluid from passing through ports 104. Indeed, any component that can selectively and substantially obstruct any portion of the fluid path between the ports 104 and an open end of the downhole tool 201 can be used to convert the downhole tool 100 from a run-in to a run-out configuration. Further, the selectivity of the obstruction can be as a result of performing another operation with a portion of the downhole tool, such as setting a plug, or by triggering a separate mechanism that causes the component to move to a position where fluid flow is allowed to pass through the port 104 and around at least a portion of the textured sleeve 101.

Figure 3:
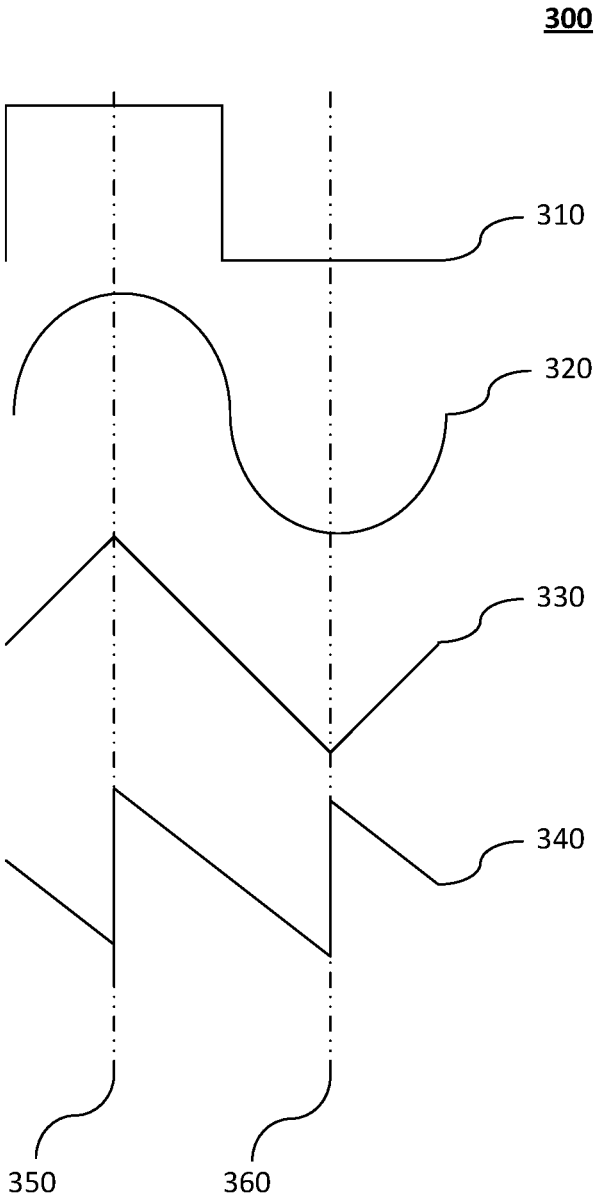
FIG. 3 depicts examples of cross-sectional patterns in accordance with embodiments.

FIG. 3 depicts a variety of channel and ridge designs 300 in accordance with embodiments. In some embodiments, the channels and ridges can comprise a step-like pattern 310 that repeats across the textured sleeve. In some embodiments, the channels and ridges can comprise a sinusoidal, semicircular, or other similar curved pattern 320. In some embodiments, the channels and ridges can comprise an angular or triangular pattern 330. In some embodiments, the channels and ridges can comprise a sawtooth or similar pattern 340. Each of these patterns has a maximum 350 and a minimum 360 point in the cross-section that, when fluid passes over the top of the pattern, creates turbulent flow. Further, each of these patterns can be used as shapes for the cross-sections of the textured sleeve 101, to be repeated across the length of the textured sleeve. Each of the variety of channel and ridge designs 300 is a periodic and repeating pattern that can be further modified in various ways, all of which are within the scope of the present invention. For example, other periodic designs than those shown in FIG. 3 can be used.

Figure 4:
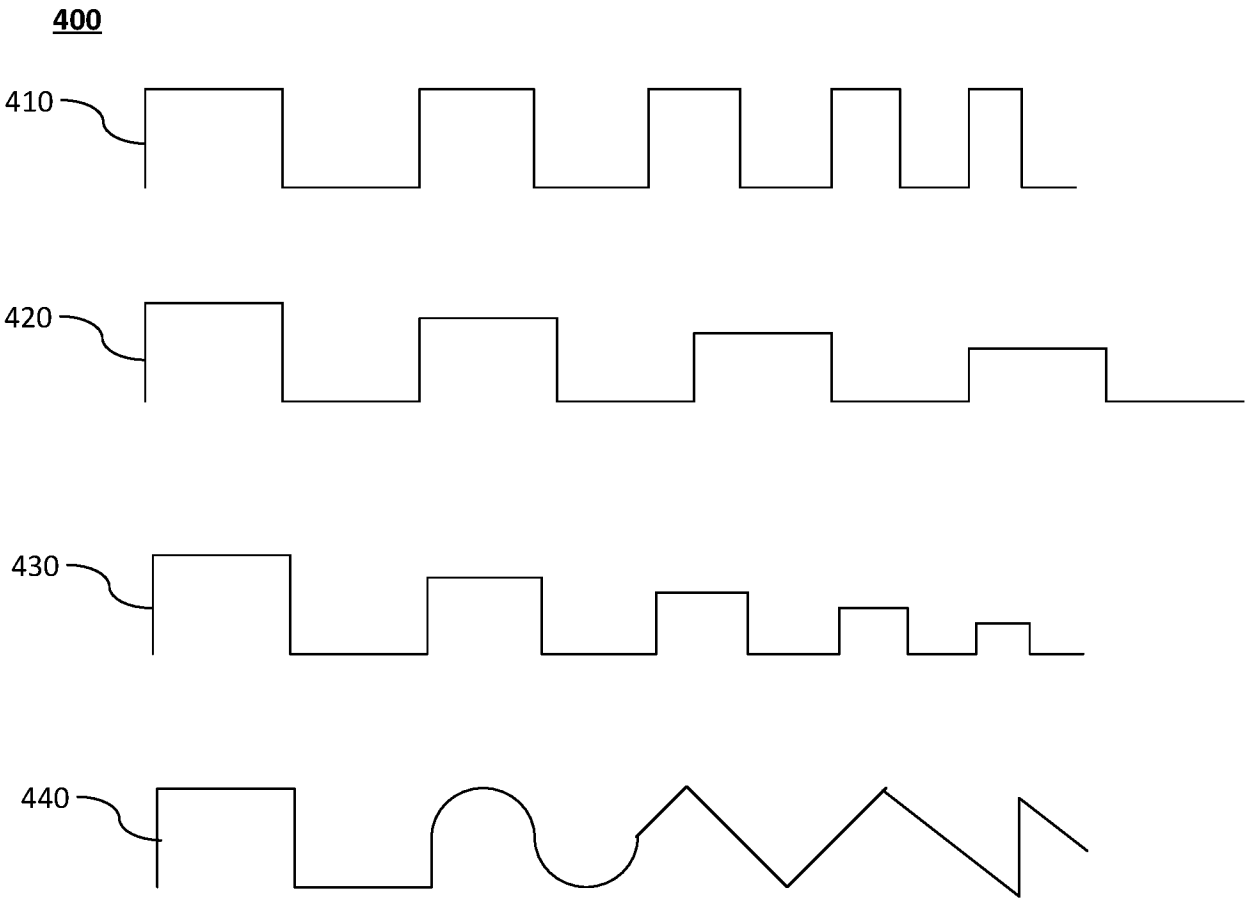
FIG. 4 depicts examples of cross-sections across the length of a textured sleeve in accordance with embodiments.

FIG. 4 depicts variations 400 in the cross-section of the textured sleeve in accordance with embodiments. Cross section 410 depicts an embodiment where the length over which the pattern repeats (the "period") decreases along the length of the textured sleeve. Cross section 420 depicts an embodiment where the maximum height of each repeating pattern (the "amplitude") decreases across the length of the textured sleeve. Cross section 430 depicts an embodiment where the amplitude and period of the pattern decreases across the length of the textured sleeve. These examples illustrate that the cross-sectional pattern need not be identically repeated across the length of the tool, but that other variations in cross-section can be used. Other variations are also possible, such as where the depth of each repeating pattern changes over the length of the textured sleeve, or a non-repeating pattern is used. Cross section 440 includes pieces of other patterns and likewise can be used in embodiments of the present invention. The final selection of a cross-sectional pattern can be selected by a person having ordinary skill in the art based on the desired pressure difference across the tool, economics of manufacturing, and other limitations, with routine experimentation.

Figure 5:
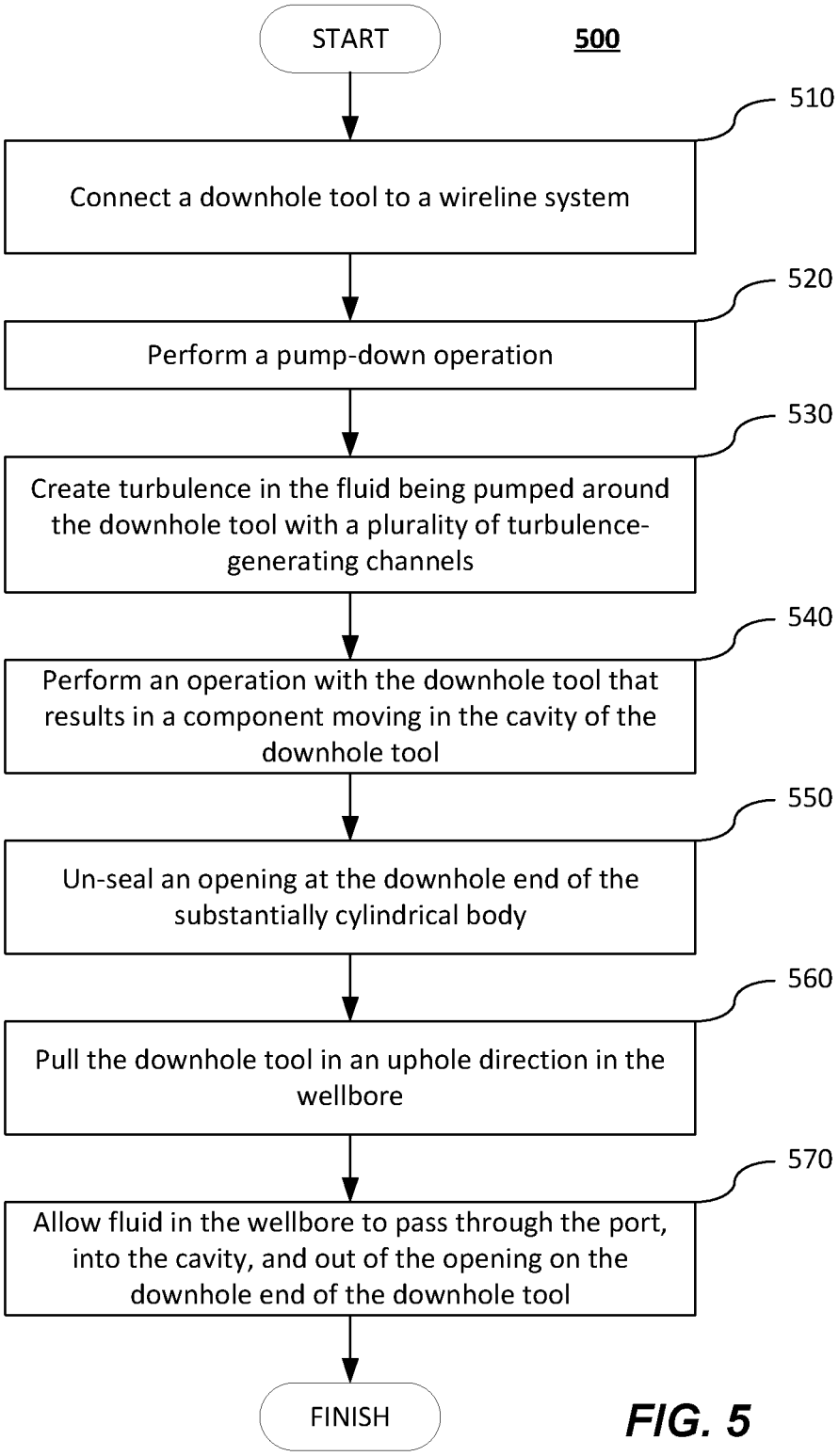
FIG. 5 depicts a method for using a downhole tool in accordance with an embodiment.

FIG. 5 is a flowchart 500 for a method using a downhole tool in accordance with the present disclosure in a pump-down operation. In some embodiments, the method comprises connecting a downhole tool to a wireline system 510. In some embodiments, the method comprises performing a pump-down operation 520. In some embodiments, the method comprises creating turbulence in the fluid being pumped around the downhole tool with a plurality of turbulence-generating channels 530. In some embodiments, the method comprises performing an operation with the downhole tool that results in a component moving in the cavity of the downhole tool 540. In some embodiments, the method comprises un-sealing an opening at the downhole end of the substantially cylindrical body of the downhole tool 550. In some embodiments, the method comprises pulling the downhole tool in an uphole direction in the wellbore 560. In some embodiments, the method comprises allowing the fluid in the wellbore to pass through the port, into the cavity, and out of the opening on the downhole end of the downhole tool 570.

The person skilled in the art realizes that the present invention is not limited to the preferred embodiments described above. The person skilled in the art further realizes that modifications and variations are possible within the scope of the appended claims. Additionally, variations to the disclosed embodiments can be understood and effected by the skilled person in practicing the claimed invention, from a study of the drawings, the disclosure, and the appended claims.

The invention claimed is:

1. A downhole tool comprising:

a substantially cylindrical body, having an uphole end and a downhole end, and an exterior surface;

a plurality of turbulence-generating channels formed in the substantially cylindrical body, each channel running along a circumference of the body substantially perpendicular to a central axis of the body;

wherein the body has a substantially cylindrical cavity therein, and wherein the body has an opening proximate to the downhole end in fluid communication with the cavity, wherein the downhole tool is configured for connection to a wireline system, wherein the body has a port between the exterior surface and cavity of the body, and wherein the port is located in an uphole direction from a portion of the plurality of turbulence-generating channels, and wherein the downhole tool comprises a setting device for wellbore plugs, and wherein the component is a mandrel of the setting device.

2. The downhole tool of claim 1, wherein the downhole tool further comprises a component disposed within the cavity that seals the opening.

3. The downhole tool of claim 2, wherein the component has a passageway having a first opening and a second opening, the first opening having substantially the same size and shape as the port, and wherein the first opening is offset from the port, and the second opening is in a downhole direction from the first opening.

4. The downhole tool of claim 1, wherein the exterior surface is adjacent to the plurality of turbulence-generating channels, wherein a radius from the axis of the substantially cylindrical body to the bottom surface of the plurality of turbulence-generating channels is smaller than a radius from the axis of the substantially cylindrical body to the exterior surface.

5. The downhole tool of claim 1, wherein a radius from the axis of the substantially cylindrical body to the maximum radius of any element of the channels is larger than the radius from the axis of the substantially cylindrical body to the exterior surface.

6. The downhole tool of claim 1, further comprising a wireline adapter located on the uphole end of the substantially cylindrical body configured to affix the downhole tool to a wireline system.

7. The downhole tool of claim 1, wherein the bottom end is semi-circular.

8. The downhole tool of claim 1, wherein the plurality of turbulence-generating channels cover a majority of the exterior surface of the downhole tool.

9. The downhole tool of claim 1, wherein the plurality of turbulence-generating channels are located proximate to the downhole end of the downhole tool.

10. The downhole tool of claim 1, having a first turbulence-generating channel and a second turbulence-generating channel in the plurality of turbulence-generating channels, and wherein the bottom surface of the first turbulence-generating channel has a smaller width than the bottom surface of the second turbulence-generating channel.

11. The downhole tool of claim 1, having a first turbulence-generating channel, a second turbulence-generating channel, and a third turbulence-generating channel in the plurality of turbulence-generating channels, wherein the first turbulence-generating channel is adjacent to the second turbulence-generating channel, wherein the second turbulence-generating channel is adjacent to the third turbulence-generating channel, and wherein the spacing between the first turbulence-generating channel and the second turbulence-generating channel is greater than the spacing between the second turbulence-generating channel and the third turbulence-generating channel.

12. A method of using a downhole tool, comprising:

connecting the downhole tool to a wireline system, wherein the downhole tool comprises:

a substantially cylindrical body, having an uphole end and a downhole end;

a plurality of turbulence-generating channels formed in the substantially cylindrical body, each channel running along a circumference of the body substantially perpendicular to a central axis of the body; and wherein the body has a substantially cylindrical cavity therein, and wherein the body has an opening proximate to the downhole end in fluid communication with the cavity, performing a pump-down operation with the downhole tool in a wellbore, wherein the plurality of turbulence-generating channels of the downhole tool create turbulence in fluid being pumped around the downhole tool, creating a force on the downhole tool in a downhole direction, wherein the downhole tool further comprises a component disposed within the cavity that seals the opening, wherein the body has a port between the exterior surface and cavity of the body, and wherein the method further comprises:

performing an operation with the downhole tool that results in the component moving in the cavity of the downhole tool and un-sealing the opening at the downhole end of the substantially cylindrical body; and pulling the downhole tool in an uphole direction in the wellbore, wherein fluid in the wellbore passes through the port, into the cavity, and out of the opening on the downhole end of the downhole tool.

13. The method of claim 12, wherein the downhole tool further comprises a setting tool and a plug in an un-set position on the downhole end of the downhole tool, and wherein the operation comprises setting the plug into a set position.

14. The method of claim 12, wherein the component of the downhole assembly has a passageway having a first opening and a second opening, the first opening having substantially the same size and shape as the port, and wherein the first opening is offset from the port, and the second opening in a downhole direction from the first opening, and wherein the step of performing an operation further comprises moving the component into a position where the first opening is in fluid communication with the port and the second opening is in communication with the downhole end of the downhole tool.

15. The method of claim 12, wherein the pumpdown operation causes the downhole tool to move in a downhole direction in the wellbore at a speed of approximately 400 to 600 feet per minute.

16. The method of claim 12, wherein the step of pulling the downhole tool in an uphole direction causes the downhole tool to move in an uphole direction at a speed of greater than 800 feet per minute.

* * * * *